US007303634B2

(12) United States Patent
Rantanen

(10) Patent No.: US 7,303,634 B2
(45) Date of Patent: Dec. 4, 2007

(54) METHOD AND APPARATUS FOR FEEDING A TREATING AGENT ONTO A MOVING SURFACE

(75) Inventor: Rauno Rantanen, Hyvinkää (FI)

(73) Assignee: Metso Paper, Inc., Helsinki (FI)

( * ) Notice: Subject to any disclaimer, the term of this patent is extended or adjusted under 35 U.S.C. 154(b) by 19 days.

(21) Appl. No.: 10/501,624

(22) PCT Filed: Jan. 15, 2003

(86) PCT No.: PCT/FI03/00025

§ 371 (c)(1),
(2), (4) Date: Jul. 15, 2004

(87) PCT Pub. No.: WO03/059528

PCT Pub. Date: Jul. 24, 2003

(65) Prior Publication Data

US 2005/0066889 A1 Mar. 31, 2005

(30) Foreign Application Priority Data

Jan. 16, 2002 (FI) ..... 20020081

(51) Int. Cl.
*B05C 5/00* (2006.01)
*B05C 3/12* (2006.01)
*B05B 7/06* (2006.01)
*D21H 23/50* (2006.01)

(52) U.S. Cl. ..... 118/325; 118/313; 118/413; 118/420; 162/265

(58) Field of Classification Search ..... 118/325, 118/313, DIG. 4, 300, 304, 410, 411, 413; 427/420; 239/505, 518; 68/200, 205 R; 162/135–137, 265–266
See application file for complete search history.

(56) References Cited

U.S. PATENT DOCUMENTS 3,667,258 A 6/1972 Newton (Continued)

FOREIGN PATENT DOCUMENTS

DE 667767 11/1938

(Continued)

OTHER PUBLICATIONS

English Translated Abstract of DE 3333592A.*

(Continued)

*Primary Examiner*—Yewebdar Tadesse
(74) *Attorney, Agent, or Firm*—Stiennon & Stiennon

(57) ABSTRACT

The apparatus has a feed apparatus (10) and an evening-out apparatus (100) placed underneath the feed apparatus. The feed apparatus (10) has a feed chamber (12) with an inlet opening (13*a*), an outlet opening (13*b*), and a nozzle plate (18) with holes (19) and communicating with the outlet opening (13*b*) of the feed chamber. The evening-out apparatus (100) has at least one inclined surface (110) which forms a downwards sloping flow path (L1) for the treating agent. Jets discharge from the feed chamber (12) outlet opening (13*b*) through the nozzle plate (18) holes (19) to form a first treating agent flow (F1). One inclined surface (110) of the evening-out apparatus (100) receives the first treating agent flow (F1) and a second treating agent flow (F2) formed into an even laminar treating agent flow on the flow path (L1) of the evening-out apparatus (100) is passed onto a moving surface (200).

6 Claims, 5 Drawing Sheets

U.S. PATENT DOCUMENTS

| | | | | |
|---|---|---|---|---|
| 4,093,016 | A | 6/1978 | Coleman | |
| 4,984,949 | A * | 1/1991 | Reckziegel | 412/8 |
| 5,143,759 | A | 9/1992 | Saito et al. | |
| 5,277,041 | A | 1/1994 | Ahrweiler et al. | |
| 5,417,797 | A * | 5/1995 | Tooker | 156/578 |
| 5,632,815 | A * | 5/1997 | Damrau et al. | 118/410 |
| 5,906,865 | A * | 5/1999 | Ellermeier et al. | 427/420 |
| 6,063,450 | A | 5/2000 | Bernert et al. | |
| 2002/0066404 | A1 | 6/2002 | Ueberschar et al. | |

FOREIGN PATENT DOCUMENTS

| | | | |
|---|---|---|---|
| DE | 31 02 132 | A1 | 8/1982 |
| DE | 33 33 592 | A1 | 4/1985 |
| DE | 3333592 | A1 * | 4/1985 |
| DE | 3714226 | A1 * | 11/1988 |
| DE | 93 02 905 | U1 | 8/1994 |
| EP | 0 609 535 | A3 | 5/1989 |
| EP | 1 209 274 | A2 | 11/2001 |
| FI | 991498 | | 6/1999 |
| JP | 61-11173 | | 1/1986 |
| WO | WO 01/02098 | A1 | 1/2001 |
| WO | WO 03/059528 | A1 | 7/2003 |

OTHER PUBLICATIONS

Englsh Translated Abstract DE 3714226A1.*

Merriam-Webster's Collegiate Dictionary, tenth Edition, p. 697.*

Search Report issued in Finnish patent No. 20030081, Aug. 27, 2002.

International Search Report issued in PCT/FI03/00025, Apr. 29, 2003.

International Preliminary Examination Report issued in PCT/FI03/00025, Apr. 29, 2004.

Written Opinion issued in PCT/FI03/00025, Oct. 22, 2003.

* cited by examiner

METHOD AND APPARATUS FOR FEEDING A TREATING AGENT ONTO A MOVING SURFACE

CROSS REFERENCES TO RELATED APPLICATIONS

This application is a U.S. national stage application of International App. No. PTC/FI03/00025, filed Jan. 15, 2003, and claims priority on Finnish App. No. FI 20020081, Filed Jan. 16, 2002.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method for feeding a treating agent onto a moving surface, and an apparatus for feeding a treating agent onto a moving surface. The moving surface can be formed of a web, a roll shell or a belt or an equivalent moving member by means of which a treating agent is transferred to the web. The web to be treated, in turn, can be a paper web, a board web in a paper or board machine or a plastic film. In this application, by the treatment of the web is meant surface-sizing, coating or another equivalent process of treating a web in which a treating agent is added at least to one surface layer of the web.

Surface sizing and coating methods can be divided roughly into contact-based methods and non-contact methods.

The contact-based methods include, for example, blade coating, film transfer coating and air knife coating. In blade coating, a treating agent is applied to the surface of the web by different methods and the excess of the treating agent layer is doctored off and the treating agent is evened out by a blade which is in contact with the web. In blade coating, as the application method it is possible to use, for example, applicator roll application or nozzle application. In film transfer coating, a desired treating agent layer is applied to the surface of a roll, from which the treating agent is transferred to the surface of the web in a nip between said roll and a backing roll. The amount of the treating agent layer is regulated by means of a doctor blade or a metering bar. In air knife coating, application is carried out, for example, by means of a roll applicator device or nozzles. The actual regulation of the amount of treating agent is performed by an air doctor. In connection with the air doctor there is additionally a mist chamber, the function of which is to collect the treating agent mist separated by the doctor and to separate treating agent particles from air.

By non-contact methods are meant methods in which the applicator device is not in contact with the surface to be coated and in which the amount of the treating agent applied to the web is not regulated any more separately after the treating agent has been applied. The non-contact coating methods include spray coating and curtain coating. In spray coating, the treating agent is pumped under high pressure through a number of small nozzles onto the surface of the web that is being treated. Small treating agent droplets impinge upon the web and spread through their own momentum on the surface of the web. In curtain coating, an even treating agent layer is formed which falls as a curtain under the force of gravity onto the surface of the web.

Curtain coating devices can be divided into coating devices which feed from a gap or which feed from a planar surface. In applicator beams that feed from a gap, a treating agent is pumped through a distribution chamber into a narrow gap which is situated above the web and at the lip of which a curtain is formed and flows onto the web below. In the curtain coating devices feeding from a planar surface, a treating agent is caused to flow along an inclined planar surface to the edge of the planar surface, from which the treating agent flows in the form of a curtain onto the surface of the web below.

U.S. Pat. No. 6,063,450 discloses a method and a device for feeding a treating agent directly or indirectly onto one or both sides of a continuous surface. The device comprises a nozzle array, the treating agent being fed from its nozzles under pressure towards a deflection means, i.e. a curved impact plate. The direction of treating agent jets is changed by means of the curved impact plate such that the treating agent jets are directed at the surface of a web running on the outer shell of a supporting roll (direct application) or at the surface of the outer shell of the supporting roll (indirect application). In indirect application, the treating agent is transferred from the outer surface of the supporting roll to the web in a nip between the supporting roll and a backing roll. After the point where the treating agent impinges upon the surface of the web running on the outer shell of the supporting roll or upon the surface of the outer shell of the supporting roll, evening out of the treating agent layer and adjustment of its thickness are further carried out by means of a doctor roll placed against the supporting roll. In the embodiments described in the patent, the nozzle array and the impact plate are situated below the web and the supporting roll. The treating agent discharges from the nozzles in a horizontal direction or obliquely upwards with respect to the horizontal direction. From the trailing edge of the impact plate the treating agent discharges almost vertically or at a small angle to the vertical direction towards the web or the outer shell of the supporting roll. The kinetic energy of the treating agent discharging from the nozzles must be relatively high in order that this kind of application against the force of gravity should be possible.

U.S. Pat. No. 4,093,016 discloses a method for manufacturing a paper web formed of several layers. Pulp is fed onto a wire supporting the web at locations spaced from one another, whereby a web composed of superimposed layers is formed. In addition, starch is fed onto the upper surface of at least one layer from a separate device that applies curtain coating. The device comprises a chamber which is placed above the web and comprises a vertical side wall. This vertical side wall comprises a horizontally extending slot provided with a lower and an upper edge, the width of the slot being 1.6-12.7 mm in the vertical direction. The surface of the starch supplied into the chamber is kept in the chamber on such a level that it extends above the upper edge of said slot at all times. Starch is pressed out of the slot as a horizontal flow which is in contact with both the upper edge of the slot and the lower edge of the slot. The thickness of the flow is determined by the vertical width of the slot. The starch discharging from the slot falls, because of gravity, down the vertical surface beginning from the lower edge of the slot, which surface terminates at a trailing edge situated at a distance below said slot. The starch falling along the vertical surface forms a continuous curtain, which becomes attenuated when it falls downwards. The thickness of the curtain leaving the trailing edge of the vertical surface is thus smaller than the thickness of the curtain discharging from the slot. From the trailing edge of the vertical surface the attenuated continuous curtain drops onto the web below. The chamber may also be slightly turned such that said vertical flow surface forms an angle of about 10° to the vertical plane. The inclined flow surface makes it possible to reduce air entrainment in the film and stresses acting on the film.

EP Patent 609 535 discloses a curtain coating device that feeds along an inclined surface and uses a start plate. Before the coating operation is started, the start plate provided with an articulation joint is turned to a start position above the web. In the start position, a coating curtain impinges upon the inclined start plate and flows along it into a collection container. After that, the start plate is turned into a coating position, in which connection the coating curtain falls directly onto the web. The invention in this publication relates to the shape of the upper edge of the start plate, which forms one or more angles to the transverse direction of the curtain. In one embodiment, the upper part of the start plate comprises an L-shaped portion that receives the coating curtain and has a length of 2-10 mm, advantageously 3-5 mm. When the start plate is turned from the start position into the coating position, the coating curtain falls, in the intermediate position of the start plate, onto said L-shaped inclined portion of the start plate receiving the coating curtain and flows along it further onto the web. By these arrangements, attempts are made to ensure that the thickness of the coating layer that is being formed on the web does not increase during the initial phase of the coating operation. The publication mentions that one problem is that the thickness of the coating layer becomes larger during the initial stage of coating. The apparatus described in the publication is designed mainly for coating of a photographic film.

Metso Paper, Inc.'s FI Patent Application 991498, which is incorporated by reference herein, discloses an arrangement for spreading a treating agent on a moving surface in a paper or board machine. The arrangement comprises at least one feed chamber, into which the treating agent is fed, and members for guiding the treating agent from the feed chamber onto a moving web. Said means for guiding the treating agent comprise a nozzle plate, which closes at least partly said at least one feed chamber. The nozzle plate has holes which are defined by the nozzle plate around their entire periphery. By means of these holes, treatment jets are formed which are applied to the moving surface. The nozzle plate is formed of a thin plate which has at least one row of holes formed in it. The row of holes comprises holes that are relatively small and close to one another.

The feed apparatus disclosed in FI Patent Application 991498 is very simple and reliable in operation. The apparatus can be made very narrow, which means that it fits even in a gap between a roll and a coming web. Thus, the apparatus can be used at many locations where it has been difficult or impossible to apply a treating agent. In the feed apparatus, the feeding of the treating agent takes place through the holes of the thin nozzle plate. The holes are defined only by the thin nozzle plate, so the length of the holes in relation to the diameter of the holes can be made small. By this kind of arrangement the treating agent jets can be made uniform without formation of drops or mist, and the mass and the impulse force of the treating agent jet are sufficiently high for the treating agent to be transferred and attached to the surface that is being coated. In a situation in which the holes of the nozzle plate are relatively far from one another, the treating agent, when it discharges from the holes, forms separate single jets, which form a discontinuous treating agent curtain with a desired spacing in the cross direction of the moving surface. When impinging upon the moving surface, the single jets form an even uniform treating agent layer. In a situation in which the holes of the nozzle plate are very close to one another, the treating agent, when it discharges from the holes, forms a continuous treating agent curtain in the cross direction of the moving surface.

The arrangement described in this FI Patent Application 991498 operates in a very wide running speed range, and thus it is suitable as such for many kinds of sites of use. However, in certain conditions, there may be problems in connection with the arrangement.

In a situation in which the holes of the nozzle plate are relatively far from one another and attempts are made to produce treating agent jets which are separate from one another, the jet emerging from some hole may be formed incompletely or be directed askew, for example, because of the faulty edge of said hole. As a result of this, one or more individual jets may become constricted and stopped, with the result that streaks may be produced in the moving surface, i.e. the treating agent does not form an even layer on the moving surface. The problem manifests itself particularly at low flow rates of the treating agent.

In a situation in which the holes of the nozzle plate are very close to one another and attempts are made to produce a continuous treating agent curtain immediately when the treating agent discharges from the holes of the nozzle plate, the jet emerging from some hole may be formed incompletely or be directed askew, for example, because of the faulty edge of said hole. As a result of this, the continuous treating agent curtain may be broken, with the result that streaks may be produced in the moving surface, i.e. the treating agent does not form an even layer on the moving surface.

SUMMARY OF THE INVENTION

The present invention provides a solution to the problems described above, whereby the reliability of operation and the range of use of the arrangement disclosed in FI Patent Application 991498 are made still greater.

In the arrangement in accordance with the invention, the feed apparatus disclosed in FI Patent Application 991498 is turned such that the feed direction of the feed apparatus is downwards. In addition to this, at least one inclined surface is added below the feed apparatus for evening out any faults possibly existing in the treating agent flow discharging from the holes of the nozzle plate of the feed device.

In the following, some advantageous embodiments of the invention are described with reference to the figures in the appended drawings, to the details of which the invention is, however, not meant to be exclusively limited.

DESCRIPTION OF THE PREFERRED EMBODIMENTS

Figure 1:
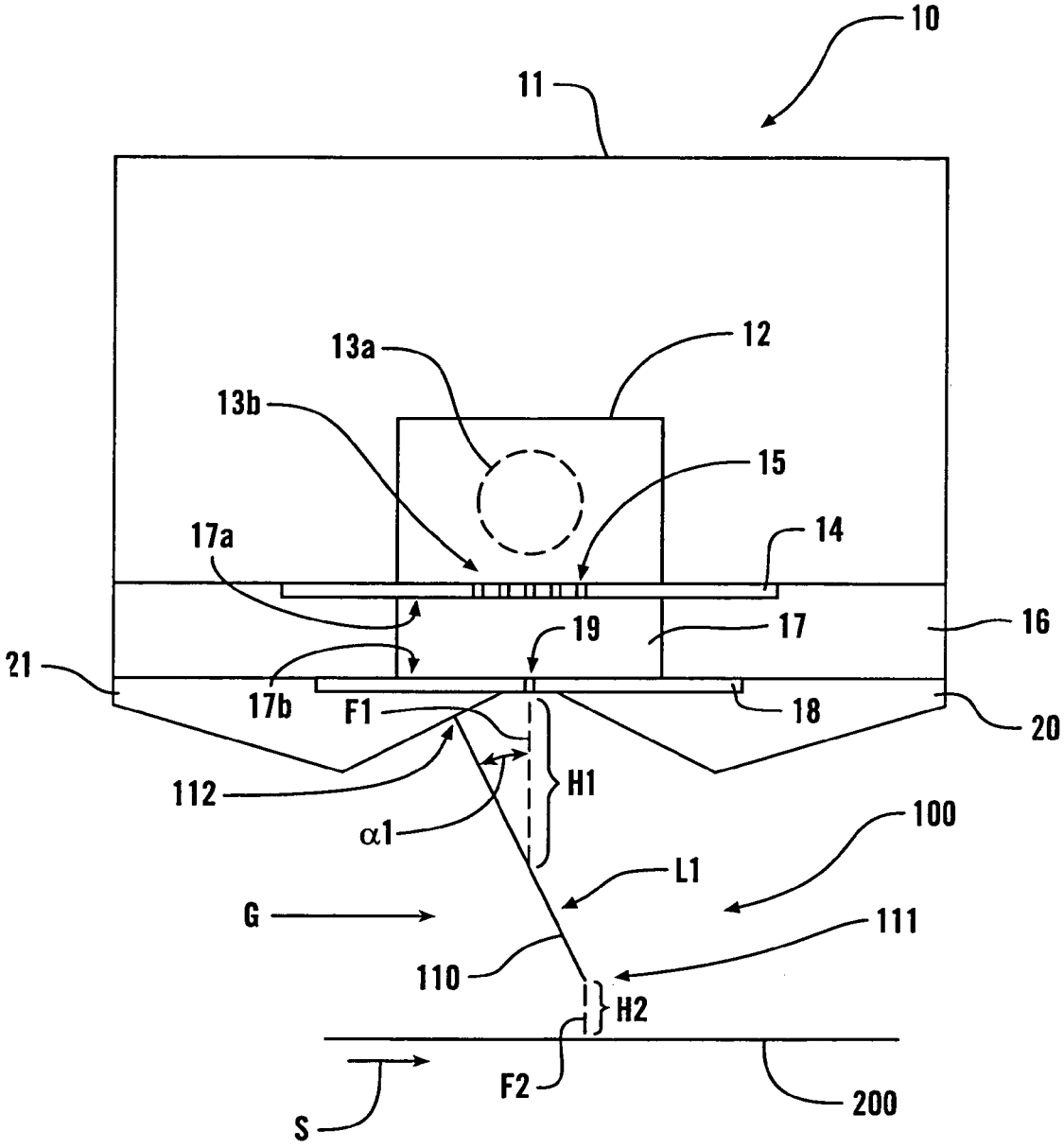
FIG. 1 is a schematic side view of one embodiment in accordance with the invention.

The apparatus of the invention shown in FIG. 1 is formed of a feed apparatus 10 of a treating agent, known in itself and disclosed in FI Patent Application 991498, and of an evening-out apparatus 100 of the treating agent disposed underneath the feed apparatus. A moving surface 200 intended to be treated with the treating agent runs under the evening-out apparatus 100.

The feed apparatus 10 of the treating agent comprises a body housing 11, an intermediate part 16, and two attachment pieces 20, 21. In the body housing 11*a* feed chamber 12 is formed which comprises an inlet opening 13*a* which is directed to the side in the figure and from which a treating agent can be fed into the feed chamber 12, and an outlet opening 13*b* which is directed downwards in the figure and from which the treating agent flows out of the feed chamber 12. The intermediate part 16, in turn, is provided with an intermediate chamber 17 which comprises an inlet opening 17*a* which is directed upwards in the figure and from which the treating agent flows into the intermediate chamber 17, and an outlet opening 17*b* which is directed downwards in the figure and from which the treating agent flows out of the intermediate chamber 17. The cross section of the inlet opening 17*a* of the intermediate chamber 17 corresponds to the cross section of the outlet opening 13*b* of the feed chamber 12.

The outlet opening 13*b* of the feed chamber 12 is closed with a screen plate 14, which is pressed against the body housing 11 by means of the intermediate part 16. The screen plate 14 has holes 15 at the outlet opening 13*b* of said feed chamber 12, through which holes the treating agent in the feed chamber 12 can flow into the intermediate chamber 17. The outlet opening 17*b* of the intermediate chamber 17, in turn, is closed by a nozzle plate 18, which is pressed against the intermediate part 16 by means of the attachment pieces 20, 21. The nozzle plate 18 has holes 19 through which the treating agent in the intermediate chamber 17 can flow out of the intermediate chamber 17.

The body housing 11, the intermediate part 16, and the attachment pieces 20, 21 can be attached to one another by means of arrangements known as such by a person skilled in the art, such as bolts, quick-release fasteners or pressure hoses and springs (not shown in the figure).

As the nozzle plate 18 it is possible to use, for example, a steel band, the thickness of which is advantageously in a range of 0.1-0.8 mm. The diameter of the holes 19 formed in the nozzle plate 18, in turn, is advantageously in a range of 0.1-1.0 mm and the unbroken neck areas between the peripheries of the holes 19 of the nozzle plate 18 are advantageously in a range of 0.1-0.7 mm at their narrowest point. The ratio of the diameter of the hole 19 of the nozzle plate 18 to the length of the hole 19 of the nozzle plate 18, i.e. to the thickness of the nozzle plate 18, is advantageously in a range of 0.5-2. Since the hole 19 of the nozzle plate 18 is very short in the flow direction, it cannot be clogged by any treating agent gradually adhering to the edges of the hole 19, but, instead, the treating agent particles smaller than the hole 19 pass easily through the hole 19. The holes 19 of the nozzle plate 18 may be situated in one or more rows or they can form an arbitrary pattern in the nozzle plate 18. The cross-sectional shape of the holes 19 of the nozzle plate 18 may be any shape, for example, round, oval, rectangular or polygonal.

As the screen plate 14 it is also possible to use, for example, a steel band, the thickness of which may be of the same order as the thickness of the nozzle plate 18. The diameter of the holes 15 of the screen plate 14 is smaller than the diameter of the holes 19 of the nozzle plate 18. The thickness of the screen plate 14 is advantageously in a range of 0.1-0.8 mm and the diameter of the holes 15 of the screen plate 14 is advantageously in a range of 0.05-0.5 mm. The holes 15 of the screen plate 14 can be situated in one or more rows or they may form an arbitrary pattern in the screen plate 14. The cross-sectional shape of the holes 15 of the screen plate 14 may be any shape, for example, round, oval, rectangular or polygonal.

The evening-out apparatus 100 of the treating agent is arranged underneath the feed apparatus 10 of the treating agent, which evening-out apparatus in this embodiment comprises an inclined plate that forms an inclined surface 110. An upper end 112 of the inclined plate 110 extends to one attachment piece 21 of the feed apparatus 10 and its lower end, i.e. a trailing edge 111, extends to a distance from the moving surface 200 situated underneath the evening-out apparatus 100.

The apparatus operates such that a treating agent is fed into the feed chamber 12 from the inlet opening 13*a* of the feed chamber 12 situated on one side of the body housing 11 of the feed apparatus 10. Depending on the application of use, the treating agent can be water, size, coating colour or another liquid material used for treating the web that is being produced. The treating agent fed into the feed chamber 12 flows into the intermediate chamber 17 through the holes 15 of the screen plate 14 that closes the outlet opening 13*b* of the feed chamber 12. The solid impurities or lumps larger than the holes 15 of the screen plate 14 which the treating agent may contain, will then remain in the feed chamber 12, from which they can be removed by circulating an additional amount of treating agent through the feed chamber 12 or in connection with the washing of the device. In a situation in which the treating agent is, for example, water or in which the diameter of the holes 19 of the nozzle plate 18 is large, for example, in a range of 0.7-1.0 mm, the screen plate 14 can be omitted altogether.

In the intermediate chamber 17, the flow of the treating agent is equalized and from the intermediate chamber 17 the treating agent flows through the holes 19 of the nozzle plate 18 that closes the outlet opening 17*b* of the intermediate chamber 17. In the holes 19 of the nozzle plate 18, jets are formed out of the treating agent, which jets are directed towards the evening-out apparatus 100 of the treating agent, i.e. towards the inclined plate 110, situated underneath the feed apparatus 10 of the treating agent. The diameter of the jets is very small, but the jets do not break into a mist, which means that their mass and impulse force are high as compared with a spray mist. In the feed chamber 12, a relatively low pressure is used, advantageously a pressure in a range of 0.01-0.5 MPa, in which connection the speed of movement of the treating agent jets discharging from the holes 19 of the nozzle plate 18 is low, i.e. in a range of 0.2-6 m/s. When the treating agent first passes through the holes 15 of the screen plate 14, the pressure drops further, so that the kinetic energy of the treating agent jets discharging from the holes 19 of the nozzle plate 18 is small.

The treating agent discharges from the holes 19 of the nozzle plate 18 with a very small kinetic energy forming a first treating agent flow F1. This first treating agent flow F1 falls freely in the air as a curtain onto the evening-out apparatus 100, i.e. the inclined plate 110 of the treating agent. By means of the inclined plate 110 it is possible to even out any faults possibly existing in the first treating agent curtain F1. When the first treating agent curtain F1 impinges upon the inclined plate 110, wets it and flows down along the inclined plate 110 by the action of the kinetic energy obtained by it and under gravity, the possibly separate treating agent flows converge. An even laminar treating agent flow is thereby established on the inclined plate 110. The treating agent discharges from the trailing edge 111 of the inclined plate 110, forming a second treating agent flow F2. This second treating agent flow F2 drops freely in the air as a curtain onto the moving surface 200, forming there a treating agent layer. The moving surface 200 may be a web to be treated, an outer shell of a roll, or a transfer belt or an equivalent moving member by which the treating agent is transferred to the web. The direction of movement of the moving surface 200 is designated by the arrow S.

The inclination of the inclined plate 110 is directed at the direction of movement S of the moving surface 200 such that a gap G, which narrows in the direction of movement S of the moving surface 200, is formed between the moving surface 200 and the inclined plate 110.

The feed apparatus 10 of the treating agent as well as the evening-out apparatus 100 of the treating agent extend across the entire width of the moving surface 200.

Figure 2:
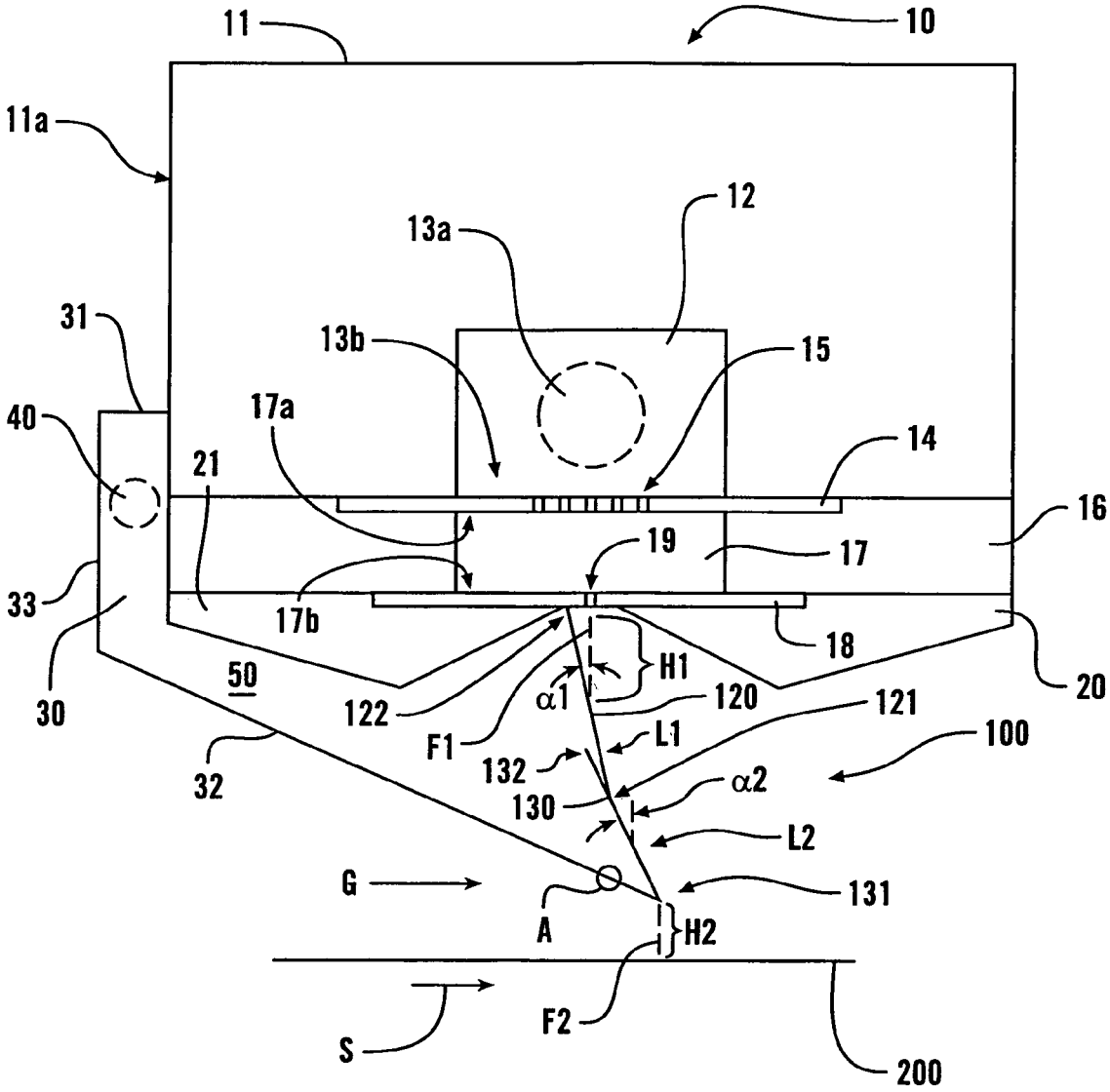
FIG. 2 is a schematic side view of a second embodiment in accordance with the invention.
Figure 2A:
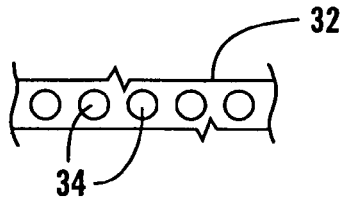
FIG. 2A is a fragmentary detail view of a portion of the oblique plate 32 indicated by the circle A.

FIGS. 2 and 2A show a second arrangement in accordance with the invention. The feed apparatus 10 of the treating agent corresponds to the feed arrangement 10 shown in FIG. 1, and thus it is not described here again.

On the other hand, the evening-out apparatus 100 of the treating agent situated underneath the feed apparatus 10 of the treating agent differs in this embodiment from the evening-out apparatus 100 shown in FIG. 1. As shown in FIG. 2, here, the evening-out apparatus 100 is formed of two inclined plates which form two inclined surfaces 120, 130. A first upper inclined plate 120 rests at its trailing edge 121 on a second lower inclined plate 130.

The treating agent discharges from holes 19 of a nozzle plate 18, forming a first treating agent flow F1 that falls freely in the air as a curtain. This first treating agent curtain F1 falls onto the first inclined plate 120, on which it flows a given first distance L1 downwards towards the trailing edge 121 of the first inclined plate 120. From the trailing edge 121 of the first inclined plate 120, the treating agent passes onto the second inclined plate 130, on which it flows a given second distance L2 downwards towards a trailing edge 131 of the second inclined plate 130. From the trailing edge 131 of the second inclined plate 130, the treating agent discharges and forms a second treating agent flow F2 that falls freely in the air as a curtain. This second treating agent curtain F2 falls onto the moving surface 200 below, forming there a treating agent layer.

An upper end 122 of the first inclined plate 120 extends to one attachment piece 21 of the feed apparatus 10 and an upper end 132 of the second inclined plate 130 extends to a distance underneath the body housing 11 of the feed apparatus 10. A side housing 30 is additionally provided on the side surface of the body housing 11 of the feed apparatus 10. The side housing 30 comprises a horizontal wall 31 extending outwards from the body housing of the feed apparatus 10, and an oblique wall 32 situated below the feed apparatus 10, as well as a vertical wall 33 connecting these two walls. The oblique wall 32 extends to the lower end 131 of the second inclined plate 130. This side housing 30 forms together with the first inclined plate 120, the second inclined plate 130 and the outer surface of the feed apparatus 10 a closed space 50, the open ends of which on the side of the body housing 11 are closed by means of suitable end pieces (not shown in the figure). A vacuum can be arranged in this closed space 50, for example, by means of a fan 40 disposed on one end piece of the closed space 50. The oblique wall 32 of the side housing 30 can be provided with holes 34, as shown in FIG. 2A. In that connection, the air cushion carried by a moving surface 200 with it can be sucked from a narrowing gap G between the moving surface 200 and the oblique wall 32 of the side housing 30 through the holes 34 provided in the oblique wall 32 into said closed space 50 and further out of it into the air surrounding the apparatus by means of said fan 40. The air cushion carried by the moving surface 200 with it is already problematic at speeds of over 400 m/min, the air cushion breaking the second treating agent curtain F2 that falls onto the moving surface 200.

Figure 3:
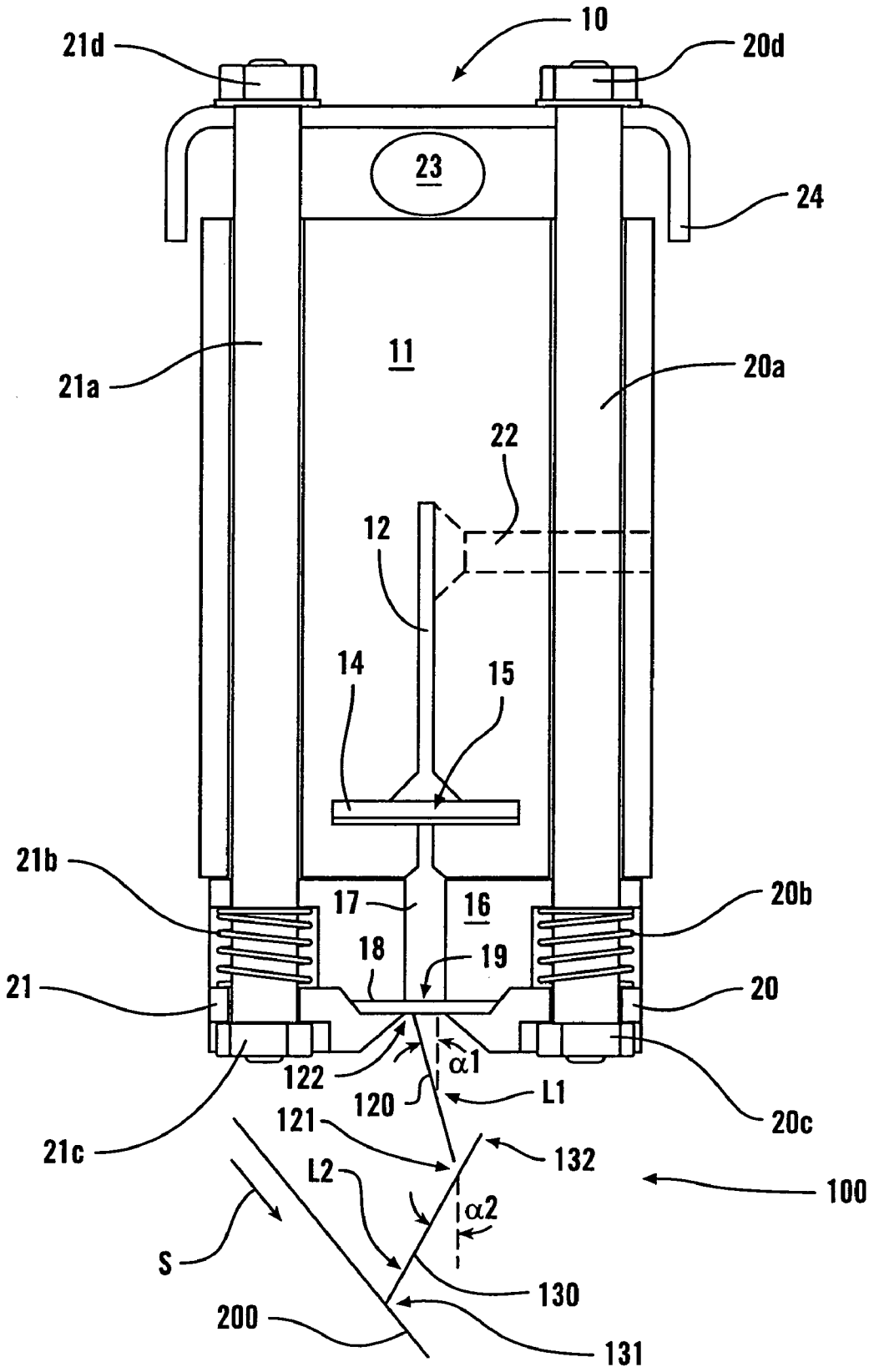
FIG. 3 is a schematic side view of a third embodiment in accordance with the invention.

FIG. 3 schematically shows a third embodiment in accordance with the invention, viewed from the side. The feed apparatus 10 and the evening-out apparatus 100 of the treating agent differ here slightly from the feed apparatus 10 and the evening-out apparatus 100 of the treating agent shown in FIGS. 1 and 2.

The feed apparatus 10 comprises a body housing 11, an intermediate part 16, two attachment pieces 20, 21, attachment means 20*a*, 20*b*, 20*c*; 21*a*, 21*b*, 21*c*, expansion means 23, and a support part 24. Pins 20*a*, 21*a* included in the attachment means extend through the support part 24, the body housing 11 and the attachment pieces 20, 21. At the lower end of the pins 20*a*, 20*b* there are nuts 20*c*, 21*c* which are supported on the outer surface of the attachment pieces 20, 21. The attachment pieces 20, 21 are supported at their inner surfaces on the intermediate part 16 by means of springs 20*b*, 21*b* surrounding the pins. At the upper end of the pins 20*a*, 21*a* there are also nuts 20*d*, 20*d* which are supported on the upper surface of the support part 24. The support part 24, in turn, is supported at its bottom surface on the body housing 11 by means of an expansion hose 23. The feed apparatus 10 is illustrated in the operating position, the expansion hose 23 being pressurized. In that connection, the attachment pieces 20, 21 press a nozzle plate 18 against the lower surface of the intermediate part 16. When pressure is removed from the expansion hose 23, the springs 20*b*, 21*b* press the attachment pieces 20, 21 in the figure downwards such that the nozzle plate 18 pressed between the attachment pieces 20, 21 and the intermediate part 16 can be detached from the feed apparatus 10.

A feed chamber 12 has been provided in the body housing 11, and a treating agent can be fed into said feed chamber through a duct 22 directed to the side in the figure. The location at which said duct 22 is connected to the feed chamber 12 forms an inlet opening of the feed chamber. A screen plate 14 provided with holes 15 is fitted in an outlet opening of the feed chamber 12. In the intermediate part 16, in turn, there is provided an intermediate chamber 17, which communicates with the feed chamber 12. The outlet opening of the intermediate chamber 17 is closed by a nozzle plate 18 which has holes 19.

The evening-out apparatus 100 of the treating agent is arranged underneath the feed apparatus 10 of the treating agent, the evening-out apparatus in this embodiment comprising two inclined plates which form two inclined surfaces 120, 130. An upper end 122 of a first inclined plate 120 extends to the bottom surface of the nozzle plate 18 of the feed apparatus 10 and its lower end, i.e. its trailing edge 121 extends to a distance below the feed apparatus 10. An upper end 132 of a second inclined plate 130 extends to the level of or above the lower end 121 of the first inclined plate 120 and a lower end 131 of the second inclined plate 130 rests against a moving surface 200.

The treating agent jets discharging from holes 19 of the nozzle plate 18 of the feed apparatus 10 pass directly onto the first inclined plate 120 and flow along it to the trailing edge 121 of the first inclined plate 120. From the trailing edge 121 of the first inclined plate 120 the treating agent flow passes onto the second inclined plate 130, along which the treating agent flow flows downwards and passes from the trailing edge 131 of the second inclined plate 130 onto the moving surface 200. On the first inclined plate 120 the treating agent flow flows along a first flow path L1 such that gravity presses the treating agent flow against the first flow path L1 defined by the upper surface of the first plate 120. On the second inclined plate 130, the treating agent flow flows in a corresponding manner along a second flow path L2 such that gravity presses the treating agent flow against the second flow path L2 defined by the upper surface of the second inclined plate 130. The second inclined plate 130 acts here like a blade coater, but the thickness of the treating agent layer being formed on the moving surface is not actually regulated by said second inclined plate but it acts primarily as a spreading member for the treating agent. Here, the first inclined plate 120 can, of course, be also omitted altogether, in which case the treating agent falls from the holes 19 of the nozzle plate 18 directly onto the second inclined plate 130.

Figure 4:
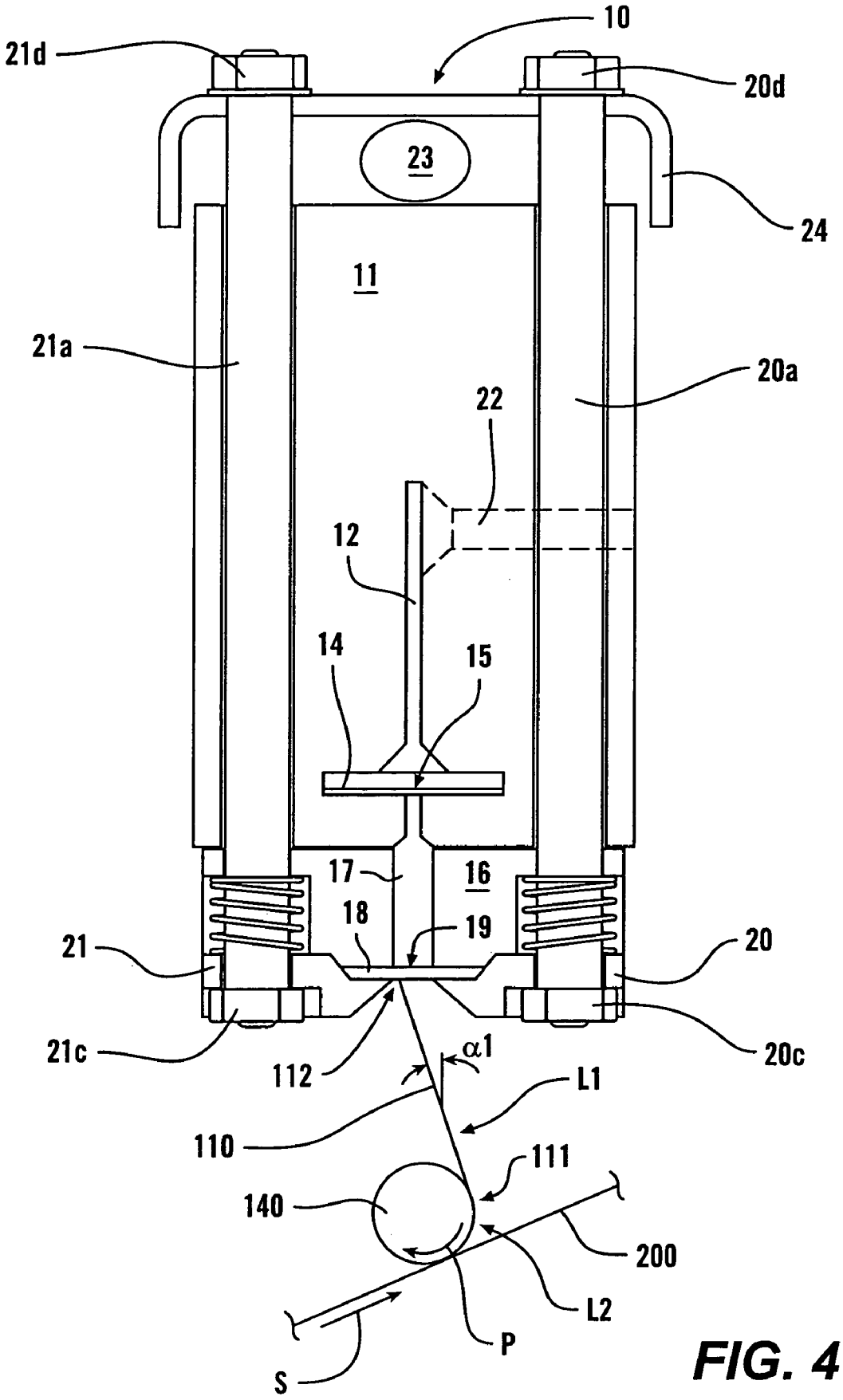
FIG. 4 is a schematic side view of a fourth embodiment in accordance with the invention.

FIG. 4 schematically shows a fourth embodiment in accordance with the invention, viewed from the side. The feed apparatus 10 of the treating agent corresponds here to the feed apparatus shown in FIG. 3, so it is not described here again, while the evening-out apparatus 100 shown in FIG. 4 differs from the evening-out apparatus 100 shown in FIG. 3.

The evening-out apparatus illustrated in FIG. 4 comprises a plate forming an inclined surface 110 and having an upper end 112 which extends to the bottom surface of a nozzle plate 18, and a lower end, i.e. a trailing edge 111 which rests against the outer surface of a cylindrical applicator rod 140. The applicator rod 140, in turn, is in contact with a moving surface 200. The direction of rotation P of the applicator rod 140 is against the direction of movement S of the moving surface 200. The treating agent passes from holes 19 of the nozzle plate 18 onto the inclined plate 110 and flows along a first flow path L1 downwards to the trailing edge 111 of the inclined plate 110, from which it passes onto the outer surface of the applicator rod 140. On the outer surface of the rotating applicator rod 140, the treating agent passes along a second flow path L2 onto the moving surface 200 at a point of contact between the applicator rod 140 and the moving surface 200. The rotating applicator rod 140 forms here a curved second inclined surface. The direction of movement S of the moving surface 200 may also be opposite to that shown in the figure, in which connection the direction of rotation P of the applicator rod 140 is in accordance with the direction of movement S of the moving surface 200.

Figure 5:
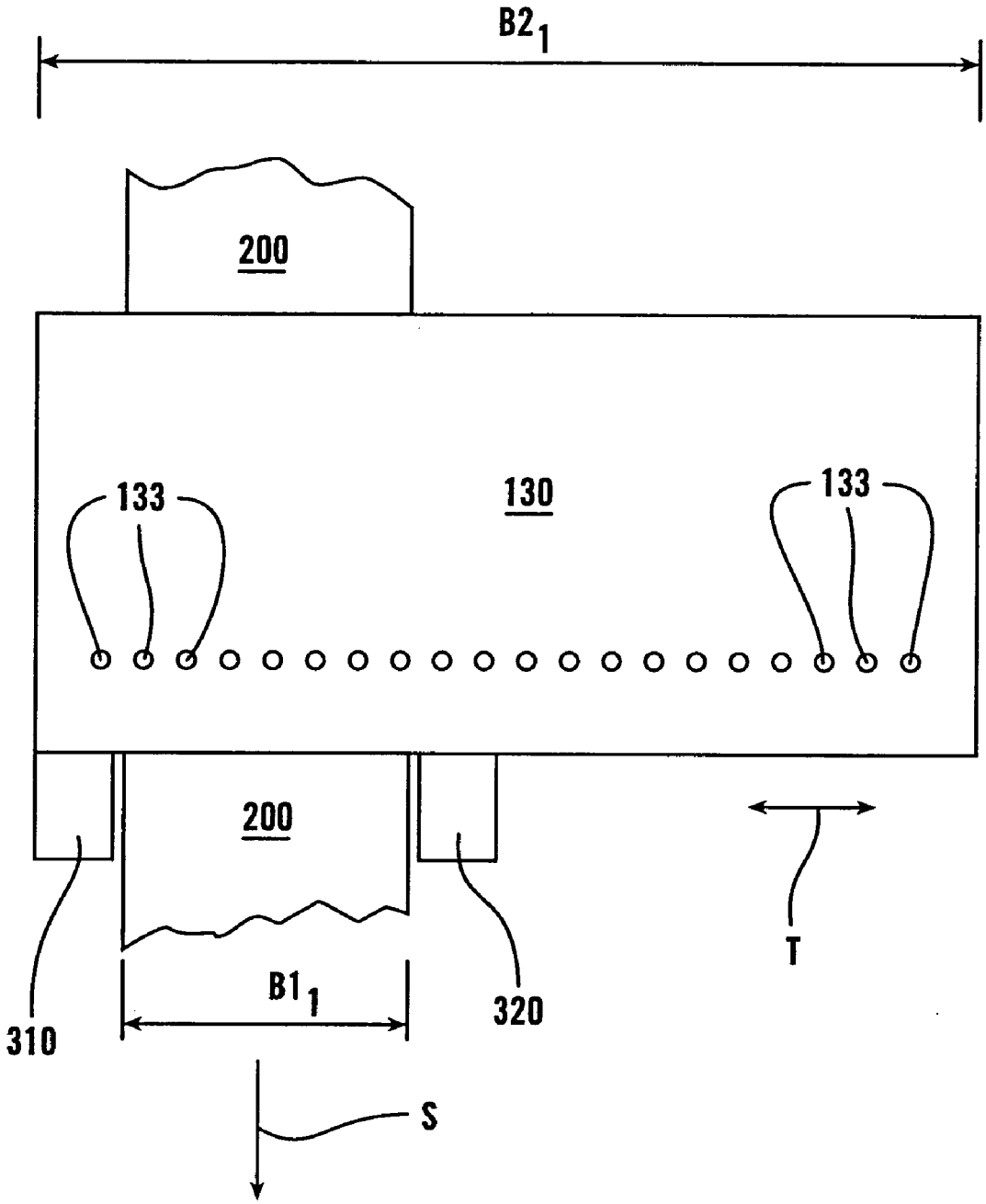
FIG. 5 is a schematic top view of a variant of the embodiment shown in FIG. 2.

FIG. 5 shows a variant of the evening-out apparatus 100 shown in FIG. 2, viewed from the top. In this embodiment, the plate defining a second inclined surface 130 has been arranged to be movable in a direction T transverse to the direction of movement S of a moving surface 200. In this case, the length B2 of the second inclined plate 130 is at least more than 1.5 times greater than the width B1 of the moving surface 200. Actuating means 310, 320 which are connected to the second inclined plate 130 and by which the second inclined plate 130 can moved in the direction T transverse to the direction of movement S of the moving surface 200, are placed on both sides of the moving surface 200. When it is desirable to clean the second inclined plate 130, it is driven to the side on the side of either of the actuating means 310, 320 with respect to the moving surface 200. After that, the portion in question of the second inclined plate 130 at the side of the moving surface 200 can be cleaned either automatically, for example, by means of water jets (not shown in the figure) or manually. The second inclined plate 130 can be driven periodically during the treatment of the moving surface 200 from one side to the other, whereby that portion of the second inclined plate 130 which is at the side of the moving surface 200 at each particular time can be cleaned. Thus, the surface of the second inclined plate 130 coming into contact with the treating agent and in particular the trailing edge 131 of the second inclined plate can be kept clean at all times. Alternatively, the second inclined plate 130 can be formed of an endless belt loop, whereby it can be rotated continuously or periodically.

The principle shown in FIG. 5 can also be applied to the cleaning of the screen plate 14 and/or the nozzle plate 18 of the feed apparatus 10 of the treating agent, in which connection they shall be movable in a direction transverse to the direction of movement S of the moving surface 200. Such an arrangement is disclosed in the above-mentioned FI Patent Application 991498 incorporated in this application. The principle shown in FIG. 5 can, of course, be also applied to the inclined plate 110 shown in FIG. 1 and to the first inclined plate 120 shown in FIG. 2.

In the embodiment shown in FIG. 1, the evening-out apparatus 100 of the treating agent comprises one inclined plate 110, which forms a downwards sloping flow path L1 for the treating agent. In the embodiments shown in FIGS. 2 and 3, the evening-out apparatus 100 of the treating agent, in turn, comprises two inclined plates 120, 130, which form a treating agent flow path L1, L2 sloping downwards with two different inclinations. In the embodiment shown in FIG. 4, the evening-out apparatus 100 of the treating agent comprises an inclined plate 110 and a rotating applicator rod 140, in which connection the plate 110 forms a downwards sloping flow path L1 and the rod 140 forms a downwards sloping curved flow path L2. From the viewpoint of the invention, the evening-out apparatus can comprise a continuous inclined surface that slopes straight down or an inclined surface that slopes down in the form of a broken line and which has several portions of different inclinations. The inclined surface may also include curved portions. The treating agent flow path L1, L2 of the inclined surface 110, 120, 130, 140 can be even and it has been treated advantageously so that it is hydrophilic. The treating agent flow path L1, L2 of the inclined surface 110, 120, 130, 140 may also comprise grooves or ridges which extend parallel to the flow and by which the treating agent flow is sought to be evened out.

In the embodiment shown in FIG. 2, the first treating agent curtain F1 drops onto the first inclined plate 120 of the evening-out apparatus 100 and flows along the flow path L1 of the first inclined plate onto the second inclined plate 130. The situation can also be arranged such that the first treating agent curtain F1 falls directly onto the second inclined plate 130 and flows along the inclined flow path L2 on it downwards to the trailing edge 131 of the second inclined plate 130, from which the treating agent flow passes onto the moving surface 200. In that case, the first inclined plate 120 serves merely as one wall of the closed space 50.

In the embodiments shown in FIGS. 1 and 2, the treating agent falls freely in the air from the holes 19 of the nozzle plate 18 over a drop height H1 onto the first inclined plate 110, 120. In the embodiments shown in FIGS. 3 and 4, the treating agent passes directly from the holes 19 of the nozzle plate 18 onto the first inclined plate 110, 120. The free drop height H1 of the first treating agent curtain F1 is advantageously in a range of 0-20 mm.

In the embodiments shown in FIGS. 1 and 2, the treating agent falls freely in the air from the trailing edge 111, 131 of the inclined plate 110, 130 onto the moving surface 200 situated underneath. In the embodiments shown in FIGS. 3 and 4, the treating agent passes directly from the inclined plate 130 or from the applicator rod 140 onto the moving surface 200. The free drop height H2 of the second treating agent curtain F1 is advantageously in a range of 0-200 mm.

In the embodiments shown in FIGS. 1-4, the length L1 of the first flow path of the treating agent flow on the inclined plate 110, 120 is advantageously in a range of 5-100 mm. The length L2 of the second flow path is also advantageously in a range of 5-100 mm.

In the embodiments shown in FIGS. 1-4, the angle of inclination $\alpha 1$, $\alpha 2$ with respect to the vertical plane of that portion of the inclined plates 110, 120, 130 on which the treating agent flows L1, L2, is advantageously in a range of 30°-45°. The values of these angles of inclination $\alpha 1$, $\alpha 2$ are determined according to the coating conditions. If the treating agent forms a ridge at the trailing edge 111, 131 of the inclined plate 110, 130, the angle $\alpha 1$, $\alpha 2$ must enlarged, i.e. the stiffness of the inclined plate 110, 130 must be reduced, because the ridge which is in a turbulent state snatches air under it. If the angle $\alpha 2$, $\alpha 2$ is too large, then the air cushion carried by the moving surface 200 with it presses itself from the trailing edge 111, 131 of the inclined plate 110, 130 through the treating agent curtain which falls onto the moving surface 200. It is also possible that the treating agent curtain falling from the trailing edge breaks, when the speed of the treating agent curtain abruptly accelerates to the speed of the moving surface 200. In that case, the angle $\alpha 1$, $\alpha 2$ must be made larger. If the speed of movement of the moving surface 200 is high, the angle $\alpha 1$, $\alpha 2$ must also be adjusted such that the treating agent curtain adheres to the moving surface 200 without causing mist.

In the embodiments shown in FIGS. 1 and 2, the inclined plates 110, 120 and 130 of the evening-out apparatus 100 are placed such that the downwards sloping flow path L1, L2 defined by them is directed in the direction of movement S of the moving surface 200. In that connection, the treating agent flowing along the inclined plate is not contaminated by the impurities possibly carried with the moving surface 200. Moreover, the air cushion carried by the moving surface 200 with it is not able to interfere with the flow of the treating agent on the inclined plate. If there is no risk of the treating agent being contaminated, the situation can be arranged such that the flow paths L1, L2 formed by the inclined surfaces 110, 120, 130 of the evening-out apparatus 100 are directed against the direction of movement S of the moving surface 200. The air cushion carried by the moving surface 200 with it may, however, impede the flowing of the treating agent from the trailing edge of the inclined surface, said treating agent falling against said air cushion.

In this application, the term 'nozzle plate' 18 has been used, but it is not a question of a plate that would comprise conventional nozzles. The holes 19 situated in the nozzle plate 18 cannot be compared to conventional nozzles. In the conventional nozzle, the flow duct of the treating agent is long in relation to the cross-sectional dimension of the flow duct of the treating agent. By contrast, in this patent application the length of the holes 19 of the nozzle plate 18 in the flow direction of the treating agent is very short in relation to the diameter of the holes 19. Thus, the holes 19 of the nozzle plate 18 do not form conventional nozzles. In addition, the treating agent discharges under a small pressure from the holes 19 of the nozzle plate 18 as compared with the pressure of a treating agent discharging from a normal nozzle.

The rear side of the inclined surface 110, 120, 130 with respect to the treating agent can be kept clean by passing water mist or water vapor or moist air to it to form condensation water. By this means, any impurities that may adhere to the inclined surface flow together with a water film and further with the treating agent film coming from the opposite side of the inclined surface onto the moving surface 200. Minor impurities getting onto the moving surface are not necessarily very harmful from the viewpoint of the quality of paper in a situation in which treatment is carried out in a forming section. With fairly large treating agent flow amounts it is also possible to make coating material flow on both sides of the inclined surface, whereby the inclined plate is kept clean on both sides.

The nozzle plate 18 may have only one row of holes 19, in which case the treating agent impinges upon the inclined surface as separate jets or as a continuous curtain. In that connection, the separate jets impinge upon the inclined surface in a substantially straight line and so does the continuous curtain. The nozzle plate 18 may also have two rows of holes 19 such that the holes 19 are situated in a staggered relationship. In that connection, the jets impinge upon the inclined surface in two rows spaced from each other. The treating agent jets discharging from the holes 19 situated closer to the inclined surface in a vertical direction form a film on the inclined surface, and the treating agent jets discharging from the holes 19 situated farther from the inclined surface in a vertical direction plough through the film in the same way as a ship produces waves. When there are several ships parallel to one another, cross waves are generated.

The flows moving crosswise in a transverse direction prevent, for example, a dirt particle or an air bubble from causing the flow flowing on the inclined surface to be torn. If a wound is formed in the treating agent flow flowing on the inclined surface, the cross flows run over it and stitch up the wound making the curtain whole again. If some treating agent jet discharging from a hole 19 of the nozzle plate 18 is not completely parallel with the other treating agent jets, this may cause streaks in the treating agent flow flowing on the inclined surface. The cross flows also rectify this situation.

The claims are presented in the following and the details of the invention may vary within the inventive idea defined by said claims and differ from the disclosure given above by way of example only.

The invention claimed is:

1. An apparatus in a paper or board machine for feeding a treating agent onto a continuous moving paper or board web comprising:

a feed apparatus having at least one feed chamber, the feed chamber having at least one inlet opening for the treating agent and at least one outlet opening for the treating agent;

at least one nozzle plate having portions forming a plurality of holes which communicate with the at least one outlet opening of said at least one feed chamber; wherein the plurality of holes are arranged to form downwards moving jets of treating agent;

at least one downwards sloping inclined surface positioned to receive the downwards moving jets of treating agent from the plurality of holes in the at least one nozzle plate, the at least one inclined surface forming a downwards sloping flow path on which an even laminar treating agent flow may be formed, the at least one inclined surface having portions forming a lowermost edge; and an applicator rod forming a cylindrical surface, the applicator rod mounted for rotation so that the cylindrical surface also rotates and positioned such that the lowermost edge of the at least one inclined surface rests against the cylindrical surface, wherein the cylindrical surface is in contact with the continuous moving paper or board web and forms a second inclined surface such that the continuous moving paper or board web is positioned beneath the applicator rod, wherein the paper or board machine includes a paper or board forming section.

2. The apparatus of claim 1, wherein the apparatus for feeding a treating agent being located in said forming section.

3. An apparatus for feeding a treating agent onto a moving surface having a defined direction of movement and defining a width, the apparatus comprising:

a feed apparatus having at least one feed chamber, the feed chamber having at least one inlet opening for the treating agent and at least one outlet opening for the treating agent;

at least one nozzle plate having portions forming a plurality of holes which communicate with the at least one outlet opening of said at least one feed chamber; wherein the plurality of holes are arranged to form downwards moving jets of treating agent;

a first downwards sloping inclined surface positioned to receive the downwards moving jets of treating agent from the plurality of holes in the at least one nozzle plate, the at least one first inclined surface forming a downwards sloping flow path on which an even laminar treating agent flow may be formed, the at least one first inclined surface having portions forming a lowermost edge;

a second inclined surface positioned so the lowermost edge of the first inclined surface rests on the second inclined surface so the second inclined surface can receive a laminar treating agent flow from the first inclined surface, the second inclined surface mounted for motion transverse to the defined direction of motion of the moving surface, wherein the second inclined surface has a length, transverse to the direction of movement of the moving surface, which is at least 1.5 times greater than the width of the moving surface; and actuating members connected to the second inclined surface and arranged to move the second inclined surface in the direction transverse to the direction of movement of the moving surface, so that a portion of the second inclined plate which is to one side of the moving surface can be cleaned.

4. An apparatus for feeding a treating agent onto a moving surface comprising:

a feed apparatus having at least one feed chamber, the feed chamber having at least one inlet opening for the treating agent and at least one outlet opening for the treating agent;

at least one nozzle plate having portions forming a plurality of holes which communicate with the at least one outlet opening of said at least one feed chamber;

wherein the plurality of holes are arranged to form downwards moving jets of treating agent;

a first inclined surface positioned to receive the downwards moving jets of treating agent from the plurality of holes in the at least one nozzle plate, the at least one first inclined surface forming a downwards sloping flow path on which an even laminar treating agent flow may be formed, the at least one first inclined surface having portions forming a lowermost edge;

a second inclined surface positioned so the lowermost edge of the first inclined surface rests on the second inclined surface so the second inclined surface can receive a laminar treating agent flow from the first inclined surface, the second inclined surface having a lower end positioned spaced from or touching the moving surface; and a wall extending upwardly from the lower end of the second inclined surface forming a closed space, the closed space connected to a source of vacuum, the wall having a plurality of holes positioned behind the second inclined surface to suck an air cushion carried by the moving surface into the closed space.

5. An apparatus in a paper or board machine for feeding a treating agent onto a continuous moving paper or board web comprising:

a feed apparatus having at least one feed chamber, the feed chamber having at least one inlet opening for the treating agent and at least one outlet opening for the treating agent;

at least one nozzle plate having portions forming a plurality of holes which communicate with the at least one outlet opening of said at least one feed chamber; wherein the plurality of holes are arranged to form downwards moving jets of treating agent;

at least one downwards sloping inclined surface positioned to receive the downwards moving jets of treating agent from the plurality of holes in the at least one nozzle plate, the at least one inclined surface forming a downwards sloping flow path on which an even laminar treating agent flow may be formed, the at least one inclined surface having portions forming a lowermost edge; and an applicator rod forming a cylindrical surface, the applicator rod mounted for rotation so that the cylindrical surface also rotates and positioned such that the lowermost edge of the at least one inclined surface rests against the cylindrical surface, wherein the cylindrical surface is in contact with the continuous moving paper or board web, wherein the paper or board machine includes a paper or board forming section.

6. The apparatus of claim 5, wherein the apparatus for feeding a treating agent being located in said forming section.

* * * * *